United States Patent [19]

Ray et al.

[11] 4,039,361

[45] Aug. 2, 1977

[54] DRY BLASTING AGENTS

[75] Inventors: Bhairab Nath Ray; Dhirendra Nath Bhattacharyya, both of Bihar, India

[73] Assignee: Indian Explosives Limited of I.C.I. House, Calcutta, India

[21] Appl. No.: 641,183

[22] Filed: Dec. 16, 1975

Related U.S. Application Data

[63] Continuation of Ser. No. 442,365, Feb. 14, 1974, abandoned.

[51] Int. Cl.[2] ..... C06B 33/14

[52] U.S. Cl. ..... 149/41; 149/40; 149/44; 149/46; 149/60; 149/70; 149/71; 149/76; 149/82; 149/83; 149/85

[58] Field of Search ..... 149/76, 41, 46, 82, 149/40, 60, 83, 44, 70, 85, 71

[56] References Cited

U.S. PATENT DOCUMENTS

| | | | |
|---|---|---|---|
| 3,630,250 | 12/1971 | Hradel et al. | 149/41 X |
| 3,633,512 | 1/1972 | Schlack et al. | 149/41 X |
| 3,706,611 | 12/1972 | Hastings | 149/41 X |

*Primary Examiner*—Stephen J. Lechert, Jr.
*Attorney, Agent, or Firm*—Stevens, Davis, Miller & Mosher

[57] ABSTRACT

This invention describes a method of preparation of sensitized dry blasting agents comprising a mixture of granular/powder ammonium nitrate with or without Sodium Nitrate, Potassium Nitrate, Calcium Nitrate, etc. fuel(s), and at least one sensitizer. The aid sensitizer is selected from the group comprising nitrate, chlorate, perchlorate and an organic derivative of a metal, which can exhibit variable valency and whose oxides and hydroxides are weakly basic in nature, e.g., iron, cobalt, nickel, chromium, copper, lead, etc.

Unlike the dry blasting agents known in prior art, the sensitized dry blasting agents can be detonated in small diameter boreholes with a generally available low strength detonator or specially made powerful detonator.

7 Claims, No Drawings

DRY BLASTING AGENTS

This is a Continuation of application Ser. No. 442,365 filed Feb. 14, 1974 now abandoned.

The present invention relates to sensitised dry blasting compositions and a method of preparing the same.

Dry blasting agents of ammonium nitrate-fuel oil (AN-FO) type are known for quite sometime and these mixtures find large uses in commercial blasting practices generally in large diameter. These mixtures are cheap, easy to manufacture and safe to handle, and their use is increasing rapidly in mining industries.

These conventional dry blasting agents of AN-FO type comprise ammonium nitrate as fine granules or in the form of porous or solid prills, and fuel oil, but sometimes a combination of fuels such as mixtures of fuel oil, woodmeal, light metal powders, carbonaceous fuels, etc. are also used.

The object of the present invention is to improve the sensitivity of the aforementioned conventional dry blasting agents by incorporating a metal compound, inorganic or organometallic in nature, into the mixture.

According to the present invention there is provided a method of manufacturing a sensitised dry blasting composition which comprises mixing ammonium nitrate and/or a mixture of inorganic nitrates, fuel and a sensitiser.

The present invention also provides a sensitised dry blasting composition comprising a mixture of ammonium nitrate or a mixture of nitrates, fuel and a sensitiser.

The dry blasting agents of the present invention contain besides the sensitiser granulated or powder nitrate or mixture of nitrates like Ammonium Nitrate, Sodium Nitrate, Potassium Nitrate and fuel oil, and may or may not contain other ingredients such as woodmeal, woodflour, cellulosic materials, light metals, non-metals and metalloids. Preferably, the nitrates comprise 86 to 96% by weight of the total composition. The fuel is selected from the group consisting of diesel oil, furnace oil, sulphur, urea, woodmeal, bagasse, light metals, such as aluminum, and other carbonaceous materials being either self-explosive or non-explosive or mixtures thereof. In order to provide the desired oxygen balance, it is necessary to adjust the proportion of the fuel.

The said sensitisers are selected from the group consisting of nitrates, perchlorates, chlorates and organoderivatives of iron, cobalt, chromium, nickel, lead, etc. The general feature of the metal ion is (a) they exhibit variable valency e.g. Fe (ii) - Fe (iii); Cr (ii) - Cr (iii) - Cr (iv) - Cr (v) - Cr (vi); Ni (ii) - Ni (iii); Pb (ii) - Pb (iv) etc., and (b) their oxides and hydroxides are weakly basic in nature. The said sensitisers are added in 0.5 – 5%, preferably 1 – 2%, of the total composition of the explosive. These sensitised dry blasting compositions can be detonated, unlike the currently manufactured AN-FO, with a No. 6 or Anstart Cap, depending on the type and amount of sensitiser used, in small diameter (below 2 inches) boreholes.

These sensitised dry blasting compositions can be loaded in boreholes in cartridged form or bulk-loaded with a suitable loading device.

The cartridge sensitised dry blasting compositions retain their sensitivity after prolonged storage.

The preparation of the dry blasting agents of the present invention consists of mixing Ammonium Nitrate (powder/prill) or mixture of Ammonium Nitrate, Sodium Nitrate, etc. and other ingredients with required quantities of the sensitisers generally dispersed in warm oil or in the form of concentrated solution in a ribbon type or any other suitable mixer. After the ingredients are thoroughly mixed, the resulting explosive is either cartridged by a suitable cartridging machine or bulk packed for bulk loading in the boreholes.

The invention is now illustrated by, but in no way limited to, the following examples, wherein all parts and percentages are expressed on a weight basis unless otherwise specified.

Example 1 where no sensitiser has been incorporated is included for the purpose of comparison and is not within the purview of the present invention.

The sensitivity of the explosive composition was determined by measuring the minimum initiator required to detonate the explosive in a 25 mm dia × 450 mm steel pipe. The density of explosive was measured as the packing density.

The minimum initiator was selected from the following group:

| | |
|---|---|
| No.6 detonator | 0.3 g PETN base charge |
| No.8 detonator | 0.5 g PETN base charge |
| Anstart | 1.5 g PETN |
| 10 g Pentolite | 50/50 cast TNT/PETN mixture |

EXAMPLES

Composition of the dry Blasting Agent:

| | |
|---|---|
| Ammonium nitrate | 87–92% by wt. |
| Woodmeal | 4% by wt. |
| Furnace oil | 4% by wt. |
| Sensitizer | 0–5% by wt. |

| Sl. No. | Sensitiser | Percent Sensitiser | Density, g/cc | Sensitivity (25 mm dia steel pipe) |
|---|---|---|---|---|
| 1 | Nil | Nil | 0.98 | 10 g Primex |
| 2 | Chromium nitrate | 5 | — | No.6 Al ASA det. |
| 3 | " | 2 | 0.93 | No.6 Al ASA det. |
| 4 | " | 1 | 0.92 | No.6 Al ASA det. |
| 5 | " | 0.5 | 0.90 | No.6 Al ASA det. |
| 6 | Ferric nitrate | 2.0 | 1.00 | No.6 Al ASA det. |
| 7 | Cobalt nitrate | 2.0 | 1.00 | No.6 Al ASA det. |
| 8 | Lead nitrate | 2.0 | 0.99 | No.6 Al ASA det. |

Storage Stability Composition

| | |
|---|---|
| Ammonium nitrate | 87–97% by wt. |
| Woodmeal | 4% by wt. |
| Furnace oil | 4% by wt. |
| Sensitiser | 0–5% by wt. |

| Sl. No. | Sensitiser | Percent sensitiser | Fresh firing data | Firing data after ambient storage: After 1 month | After 2 months | After 3 months |
|---|---|---|---|---|---|---|
| 1 | Nil | Nil | 10 g Primex | 10 g Primex | 10 g Primex | 10 g Primex |
| 5 | Chromium nitrate | 0.5 | No. 6 Al ASA | No. 6 Al ASA | No. 6 Al ASA | No. 6 Al ASA |
| 4 | " | 1.0 | " | " | " | " |
| 8 | " | 1.5 | " | " | " | " |
| 9 | " | 2.0 | " | " | " | " |

What we claim is:

1. A sensitised dry blasting composition comprising a mixture (1) nitrate which acts as an oxidiser selected from ammonium nitrate, a mixture of alkali or alkaline earth metal nitrates and mixtures thereof; (2) a fuel and (3) a sensitiser selected from the group of metal nitrates, metal perchlorates, metal chlorates and metal organic derivatives and mixtures thereof wherein the metal of such metal nitrates, metal perchlorates, metal chlorates and metal organic derivatives is selected from the group consisting of iron, cobalt, nickel, chromium, lead and copper.

2. The composition of claim 1, wherein the ammonium nitrate is in granular or powder form.

3. The composition as claimed in claim 1, wherein the nitrate comprises from 86 to 96% of the total weight of the composition.

4. The composition as claimed in claim 1, wherein the fuel is selected from the group consisting of diesel oil, furnace oil, sulphur, urea, woodmeal, bagasse, light metals and other carbonaceous materials being either self-explosive or non-explosive, or mixtures thereof.

5. The composition as claimed in claim 1, wherein the proportion of the fuel is so adjusted as to give the desired oxygen balance.

6. The composition as claimed in claim 1, wherein the sensitiser comprises from 0.5 to 5% by weight of the total weight of the composition.

7. The composition as claimed in claim 6, wherein the percent by weight of sensitiser is from 1 to 2.

* * * * *